US006422615B1

(12) United States Patent
Roos et al.

(10) Patent No.: US 6,422,615 B1
(45) Date of Patent: Jul. 23, 2002

(54) CLOSURE DEVICE WITH SHUTTING AID

(75) Inventors: Martin Roos, Oestrich-Winkel; Jürgen Ehret, Weinheim, both of (DE)

(73) Assignee: Mannesmann VDO AG, Frankfurt (DE)

( * ) Notice: Subject to any disclaimer, the term of this patent is extended or adjusted under 35 U.S.C. 154(b) by 0 days.

(21) Appl. No.: 09/369,042

(22) Filed: Aug. 4, 1999

(30) Foreign Application Priority Data

Jul. 20, 1998 (DE) ..... 199 33 371
Aug. 11, 1998 (DE) ..... 198 36 200

(51) Int. Cl.[7] ..... E05C 3/06
(52) U.S. Cl. ..... 292/216; 292/DIG. 23; 292/201; 49/280
(58) Field of Search ..... 292/216, 201, 292/DIG. 23; 49/280

(56) References Cited

U.S. PATENT DOCUMENTS 4,986,579 A * 1/1991 Ishikawa ..... 292/201
5,232,253 A 8/1993 Tamiya
5,411,302 A * 5/1995 Shimada ..... 292/201
5,516,164 A * 5/1996 Kobayashi ..... 292/201
5,520,425 A * 5/1996 Dowling ..... 292/201
5,564,761 A * 10/1996 Mizuki ..... 292/201
5,769,468 A * 6/1998 Armbruster ..... 292/201
5,944,367 A * 8/1999 Imaizumi ..... 292/201

FOREIGN PATENT DOCUMENTS

| | | |
|---|---|---|
| DE | 3840591 | 6/1989 |
| DE | 3900509 | 8/1989 |
| DE | 3836771 | 1/1990 |
| DE | 4130094 | 9/1992 |
| DE | 4131891 | 4/1993 |
| DE | 4222868 | 1/1994 |
| DE | 4321586 | 1/1994 |
| DE | 4311786 | 10/1994 |
| DE | 19530728 | 2/1997 |
| DE | 19634898 | 1/1998 |

* cited by examiner

*Primary Examiner*—Gary Estremsky
(74) *Attorney, Agent, or Firm*—Martin A. Farber

(57) ABSTRACT

A closure device, especially for vehicle doors, possesses a rotary latch interacting with a closure pin, a releasable ratchet for arresting the door, and a motor-driven shutting aid, which moves the door into the closed position. A problem from safety aspects is activating the shutting aid if fingers or articles are still located between the door and the bodywork. In order to reduce the risk of injury or damage, when the release mechanism is actuated, the force flow between the drive of the shutting aid and the door to be closed is simultaneously mechanically interrupted. As a result of this measure, the rotary latch is immediately released and the door springs open.

13 Claims, 4 Drawing Sheets

CLOSURE DEVICE WITH SHUTTING AID

FIELD AND BACKGROUND OF THE INVENTION

The invention relates to a closure device for doors or the like, especially of motor vehicles, having a rotary latch which interacts with a pin for the locking of the door, a ratchet which arrests the rotary latch at least in the closed position of the door and which can be released with the aid of a release mechanism, and a motor-driven shutting aid, whereby the door can be pulled over the last part of its closing travel into the closed position.

Such closure devices are known, for example, for the tailgates of vehicles in which the gate only needs to be rested lightly against the bodywork and is then pulled into the closed position by the drive of the shutting aid. Such shutting aids may become problematical if, during the closing of a door or tailgate of a vehicle, activation of the shutting aid takes place although fingers or articles are still trapped between the gate and the frame. As a result there is a considerable risk of injury or risk of damage to the vehicle, the shutting aid and the trapped article, especially since in the case of known devices actuation of the release mechanism is also ineffective while the shutting aid is in operation. Even switching off the drive of the shutting aid fails to result in the desired opening of the door because the drives are usually of self-locking design, the door or gate merely being halted in its instantaneous position. Electronic detection of a trapped finger or article by evaluation of the load current of the drive motor is impossible because the increase in load is only slight.

SUMMARY OF THE INVENTION

The object of the invention is to provide a closure device for doors, hoods, gates and the like which reduces the risk of injury or risk of damage when the shutting aid engages.

The object is achieved, according to the invention, in that, when the release mechanism is actuated, the force flow between the drive of the shutting aid and the door to be closed is simultaneously mechanically interrupted.

With the aid of the closure device according to the invention it is possible, for the first time, by simple actuation of the release mechanism, not only to move the ratchet aside, as a result of which the rotary latch is released, but also to achieve an interruption of the force flow to the shutting aid and so to ensure free rotatability of the rotary latch, so that, even in the case of self-locking drives of the shutting aid, the door or gate can be open slightly or springs open automatically under the pressure of the sealing rubber and the restoring force of the preloaded rotary latch. Fingers or articles cannot become jammed between door and frame in the first place, or at least rapid opening of the door is ensured if such a misfortune has arisen. As already indicated, the closure device according to the invention is particularly suitable for doors, gates or hoods of motor vehicles, and a use with other doors, gates or flaps, for example in the field of construction engineering, is conceivable.

Preferably, the drive of the shutting aid acts on a first eccentric member which entrains the rotary latch on the last section of its travel into the closed position. Such a drive is of simple construction and permits the gear ratio to be selected within a wide range, this being determined, inter alia, by the lever ratios existing between the first eccentric member and its pivot and between the point of engagement of the eccentric member on the rotary latch and its pivot.

In order to permit closing of the rotary latch even when the eccentric member comes to a halt in the region of the shutting position as a result of a defective drive motor, the first eccentric member preferably acts on an intermediate piece which is mounted on the pivot of the rotary latch, entrains this into the closed position and can be twisted in the opposite direction against the load of a preloaded spring relative to the rotary latch. With such an embodiment, any blocked eccentric member merely blocks the intermediate piece, while the movable rotary latch permits an emergency closure of the door or gate.

In a particularly preferred embodiment of the closure device according to the invention, the first eccentric member is arranged on a multi-membered toggle lever which is retained in a basic position by a preloaded spring, in which position the necessary shutting forces can be transmitted to the rotary latch, and which can be moved by mechanical engagement into a bent-in position in which the first eccentric member moves out of its entraining position.

The interruption of the force flow via the bending-in of a toggle lever offers the advantage that the latter automatically returns to its basic position, as a result of the preloaded spring, after completion of the release action and the system is thus restored to its original state. Breaker couplings in the force flow are also conceivable, but involve the problem that, after release has taken place, there may in some cases no longer be a defined position of the eccentric member or of any other drive member relative to the shutting of the door and to the drive motor. Toggle levers also offer the possibility of influencing the actuating force necessary to bend in the toggle lever easily by varying the lever lengths and position of the joints, and varying the point of contact, the mechanical engagement preferably taking place at a point on the toggle lever at which only a slight force is necessary to bend in the toggle lever and a short displacement travel is sufficient to move the toggle lever beyond a dead-center position. As soon as the dead-center position is passed, the further bending-in of the toggle lever against the pre-stress of the preloaded spring is effected by the drive motor of the shutting aid. The eccentric member, as it moves aside, releases the rotary latch so that a blockage is ruled out.

The release mechanism is preferably so designed that is has a manually actuated and/or motor-actuated actuating lever which, in its open position, moves the ratchet out of the engagement with the rotary latch and bends in the toggle lever, in which case it can act directly on the toggle lever. With such a construction, the release mechanism can be kept very simple, it being preferable for the actuating lever to be mounted about a common pivot with the ratchet and the latter to be capable of being twisted relative to the actuating member by the exertion of pressure by the rotary latch against a preloaded spring. This last measure ensures that the toggle lever can be bent in only when the actuating lever is actuated, so that accidental releases are avoided.

Preferably, a motor-driven second eccentric member entrains the actuating member for release purposes, provision being made, in a particularly advantageous embodiment of the invention, for the two eccentric members to be driven by a common motor which is movable between two end positions of a gearing, the door closing in the region of one end position of the first eccentric member and the second eccentric member releasing the ratchet via the actuating member in the region of the other end position with a reversed direction of rotation of the motor. In this embodiment it is possible, at low cost and with only one drive motor, also to provide motor-driven release of the closure device, in which case of course a manual intervention, or automatic intervention independent of the joint drive motor, should be provided in order to interrupt the force flow which interrupts the force flow even before the joint drive motor acts on the actuating lever. In addition to eccentrically arranged bolts, cam disks, for example, are also conceivable as eccentric members. The first eccentric member for driving the shutting aid is stepped down because of the greater forces, in other words it rotates more slowly than the second eccentric member which is designed to release the closure device as quickly as possible.

BRIEF DESCRIPTION OF THE DRAWINGS

An example of embodiment of the invention is described in detail below with reference to the attached drawings, in which.

DETAILED DESCRIPTION OF THE PREFERRED EMBODIMENT

Figure 1:
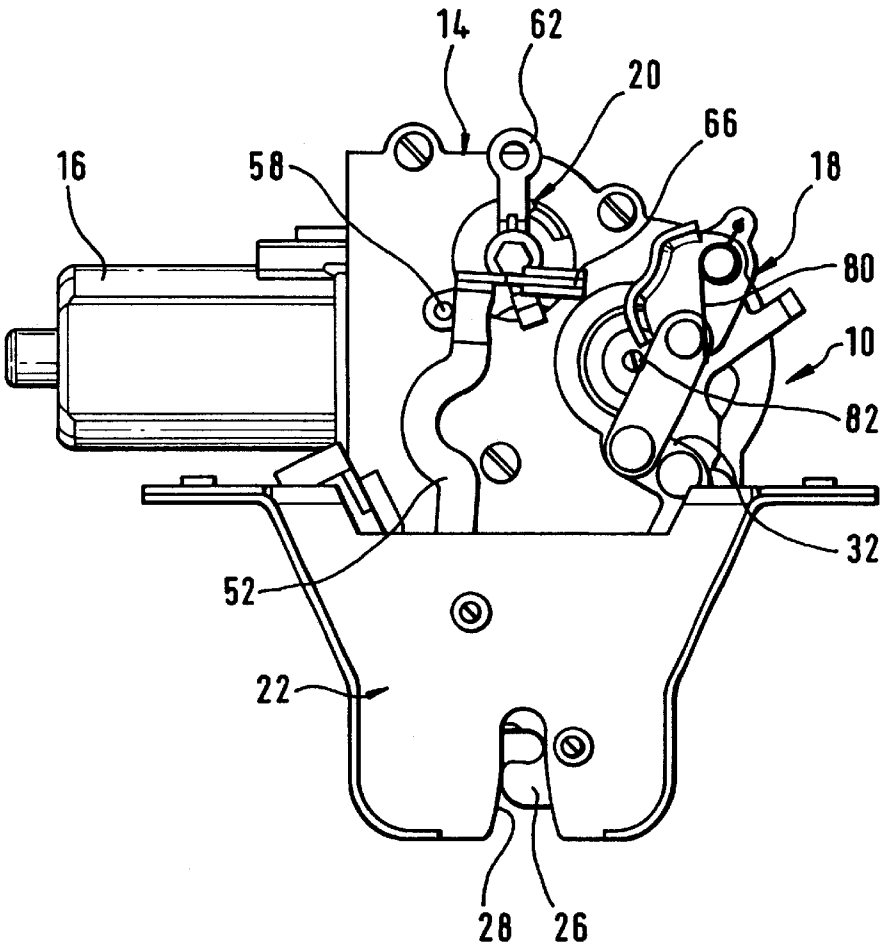
FIG. 1 shows a view of a closure device for installation in a vehicle door or tailgate.

FIG. 1 shows a closure device 10 for a vehicle tailgate. The closure device is mounted at a suitable point on the tailgate (not shown) and interacts with a closure pin 12 (see FIGS. 2 to 8), fixedly mounted on the bodywork, when the gate is closed.

Figure 2:
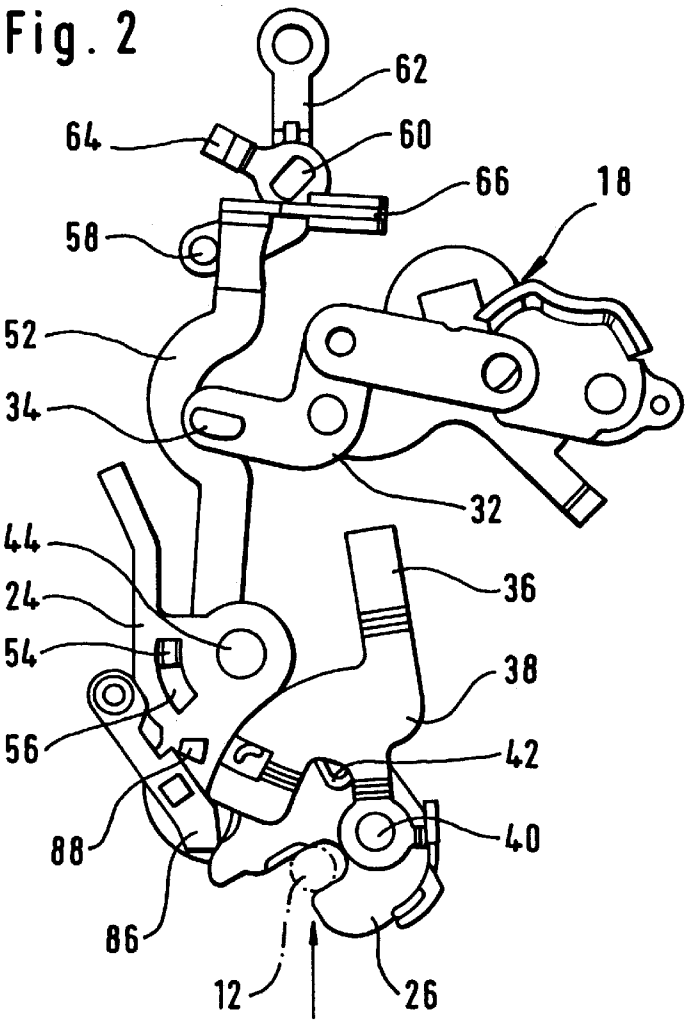
FIG. 2 shows a functional diagram of the closure device according to FIG. 1 at the start of the closure operation.

The closure device 10 essentially comprises a transmission casing 14 on which an electric motor 16 is fixed by a flange, this motor driving, via a transmission arranged in the transmission casing 14, a shutting aid 18 and a release aid 20, and a lock, covered in FIG. 2 by a lock casing 22, which essentially consists of a ratchet 24 and a rotary latch 26 which are pivotably arranged on the transmission casing 14. The lock casing 22 possesses a guide aperture 28 which, during the closure of the tailgate, ensures exact positioning of the rotary latch 26 relative to the closing pin 12.

Figure 4:
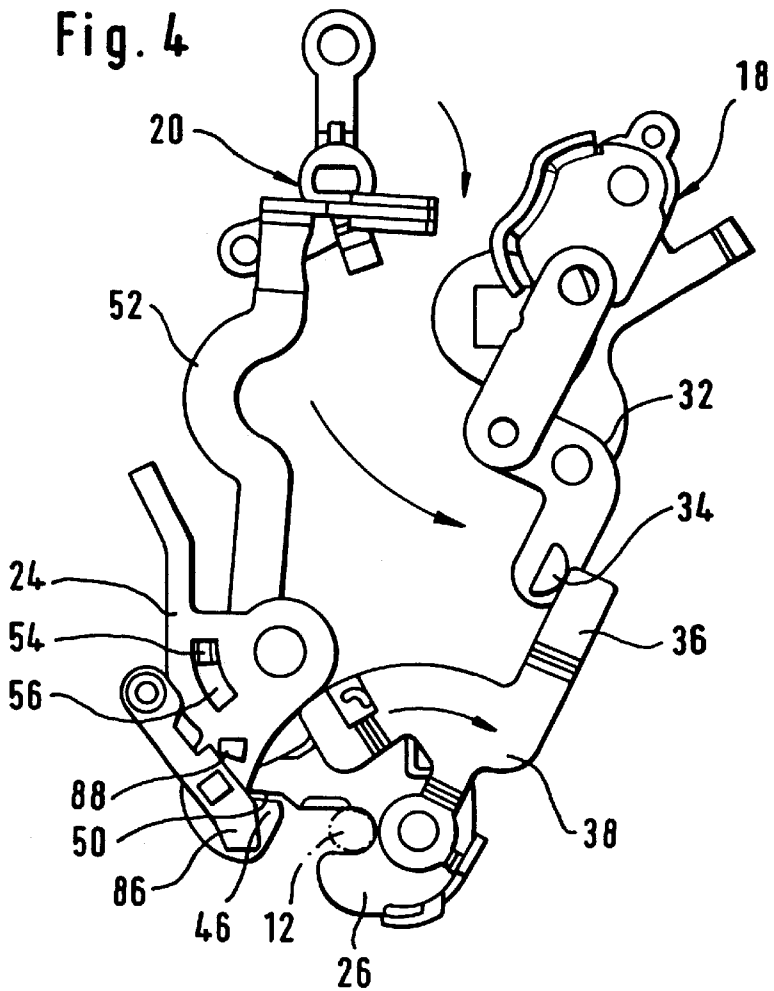
FIG. 4 shows the closure device according to FIG. 2 shortly before the closed position is reached.
Figure 3:
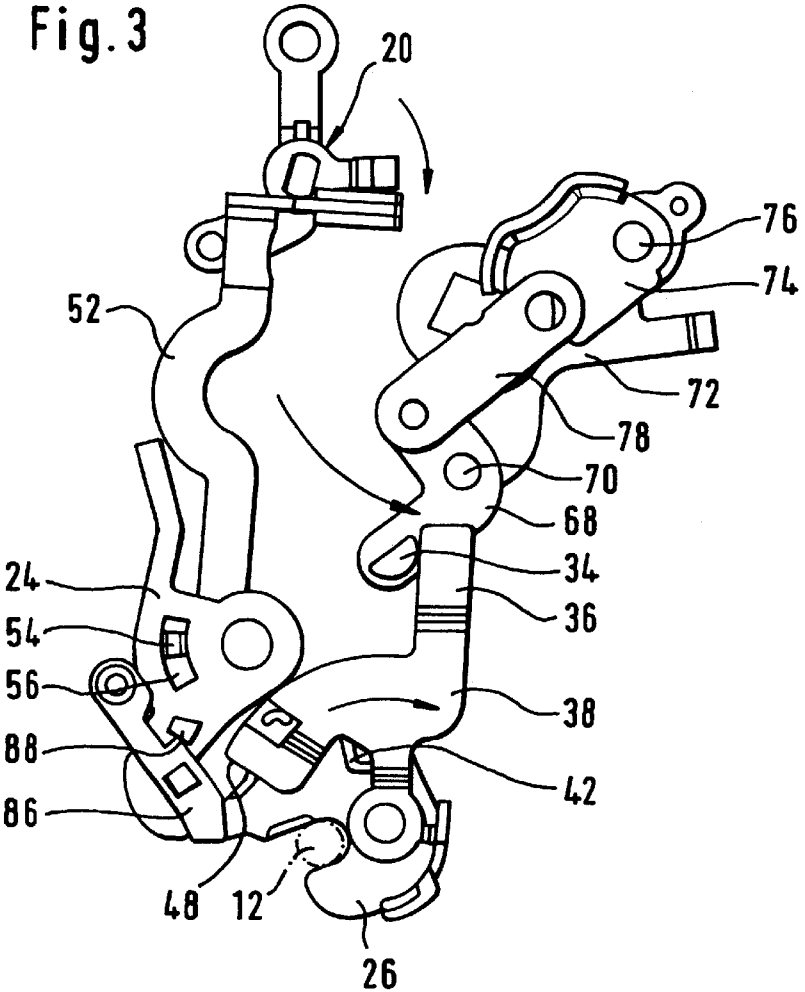
FIG. 3 shows the closure device according to FIG. 2 with the shutting aid activated.
Figure 7:
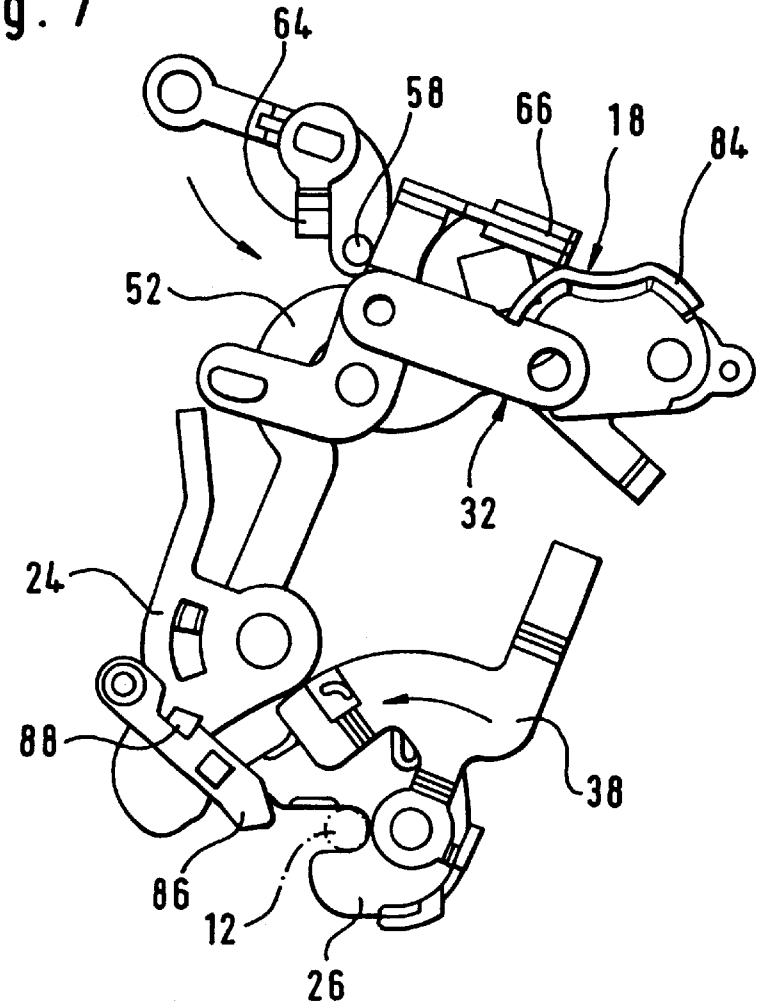
FIG. 7 shows the closure device according to FIG. 2 in the released position.

The electric motor 16 is reciprocally movable between two end positions which are defined by a toothed wheel segment (not shown) seated on the pivot of the shutting aid 18, at least one stop arranged on the casing side projecting into the segment section thereof and thus confining the pivoting path of the shutting aid 18 to approximately 90° between the shutting position shown in FIG. 4 and the release position shown in FIG. 7.

The shutting aid 18 essentially consists of a toggle lever 32 which can be driven to rotate about a pivot 30 and has a first eccentric member 34 arranged at the end thereof, further details of the construction of the toggle lever 32 and its function being given in due course.

When the shutting aid operates, the eccentric member 34 interacts with an active lever 36 of an intermediate piece 38 which is pivotably mounted together with the rotary latch 26 about a rotary latch pivot 40. The intermediate piece 38 is prestressed with the aid of a pivot-angle spring 42 against a stop on the rotary latch 26, so that the rotary latch 26 can be entrained in the closure direction by the intermediate piece 38. In the direction of opposite relative rotation, the rotary latch 26 can be twisted relative to the intermediate piece 38 to ensure that, if the intermediate piece 38 is blocked, for example as a consequence of a defective shutting aid 18, closure of the tailgate is nevertheless possible.

Figure 5:
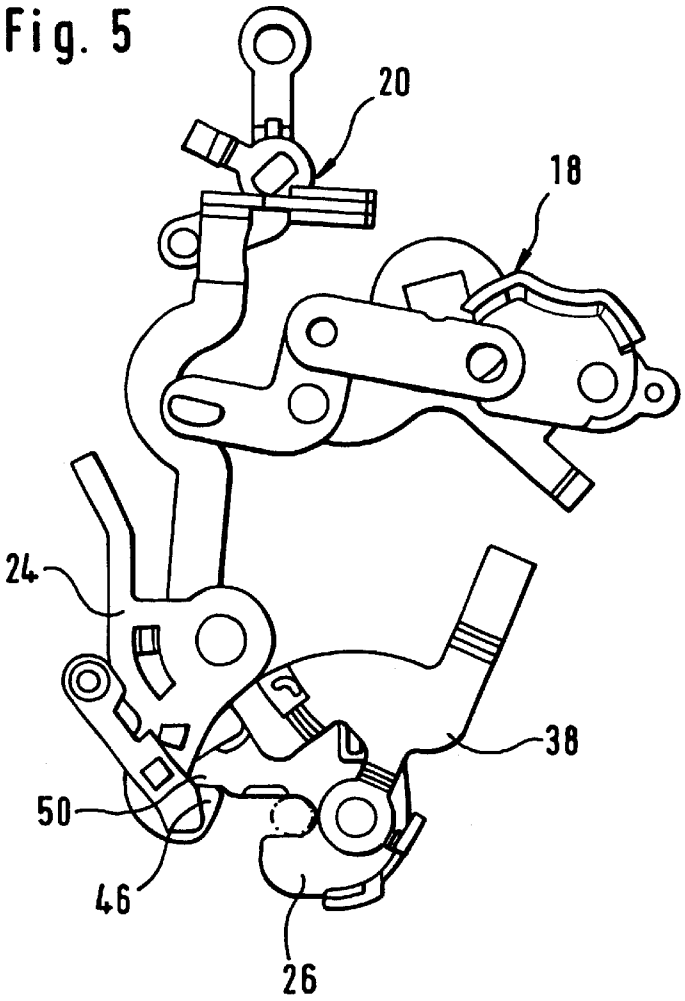
FIG. 5 shows the closure device according to FIG. 2 with the rotary latch locked in the standby position.

The ratchet 24, which is mounted to pivot about a ratchet pivot 44, possesses a latching nose 46 (see FIGS. 2 to 5) which, in the corresponding rotational position of the rotary latch 26, interacts with a preliminary catch 48 (see FIG. 3) provided on the rotary latch to arrest the tailgate in a preliminary latching position, or with a main catch 50, likewise arranged on the rotary latch 26, to retain the tailgate in its closed position (see FIG. 5). It is also conceivable for the rotary latch 26 to be designed with only one catch and the ratchet 24 with two catches to bring about the two latching positions.

An actuating lever 52, also mounted to pivot about the pivot 44, is provided to move the ratchet 24 aside into a position releasing the rotary latch 26 and, via a retaining nose 54 which comes to a stop against the end of a curved longitudinal groove 56 in the ratchet 24, entrains the ratchet 24 during pivoting. In the unloaded state, the retaining nose 54 likewise rests against the end of the longitudinal groove 56 under the load of a preloaded spring (not shown), so that a relative pivoting of the ratchet 24 relative to the actuating lever 52 is possible (see, for example, FIGS. 3 and 8). A second eccentric member 58 is provided to pivot the actuating lever 52 into a position releasing the ratchet 24 (see FIG. 7) and is pivotable against the load of a preloaded spring (not shown) about a pivot 60. The preloaded spring holds the eccentric member against a stop in a position of rest (see FIGS. 2 to 5), which simultaneously defines the end stop of the actuating lever 52 by bearing on the second eccentric member 58.

A hand lever 62, rigidly connected for rotation to the second eccentric member 58, is provided, is mechanically connected to the tailgate handle, and permits manual release of the closure apparatus.

Also arranged on the pivot 60 is a rotatable entraining member 64 which is likewise coupled via the transmission to the electric motor 16 but possesses an opposite direction of rotation to the shutting aid 18 and, because of a different step-down ratio, possesses a wider range of twisting of almost one complete rotation between the two end positions (see FIGS. 4 and 7). The entraining member 64 is so designed that it entrains the eccentric member 58 only in a restricted range of rotation during release of the closure device and, moreover, performs a free rotary movement. This uncoupling also ensures that the hand lever 62 can be actuated independently of the position of the entraining member 64.

As a special feature, the actuating lever 52 possesses an actuating cam 66, with the aid of which the actuating lever 52 can act on the toggle lever 32 of the shutting aid 18.

The toggle lever 32 consists of a first, L-shaped lever member 68, on which the first eccentric member 34 is arranged and which is mounted to pivot about a first rigid pivot pin 70 on a retaining plate 72 which is pivotable about the pivot 30 of the shutting aid 18, a second lever member 74, which is mounted to pivot about a second rigid pivot pin 76 on the retaining plate 72, and a middle lever member 78, which connects the other two lever members 68, 74 to one another in an articulated manner. A preloaded spring 80 holds the toggle lever 32 in an extended position, in which the middle lever member 78 rests against a stop 82. In this position, the toggle lever 32 is able to exert the necessary shutting forces on the active lever 36, via the first eccentric member 34, to shut the rotary latch 26.

Figure 6:
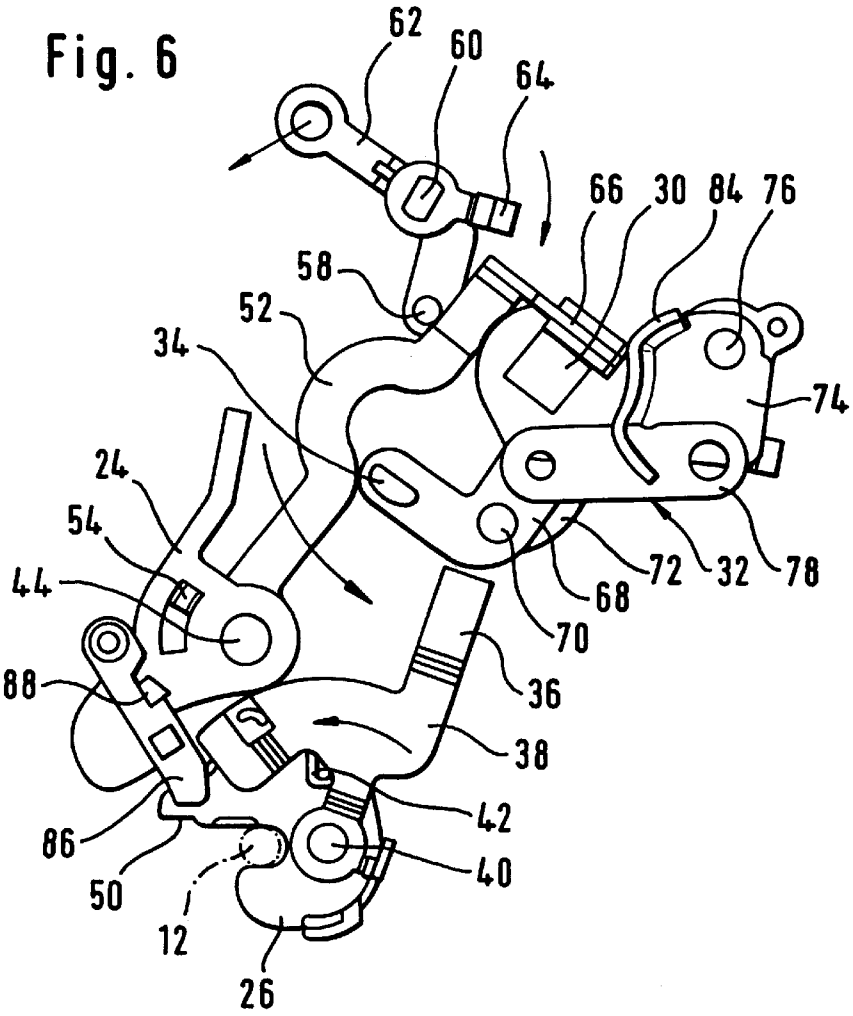
FIG. 6 shows the closure device according to FIG. 2 in an emergency release position.

Also provided on the second lever member 34 is a contact surface 84 which, on actuation of the releasing aid 20, interacts with the actuating cam 66 arranged on the actuating lever 52 in a corresponding position of the shutting aid 18 (see FIG. 6). In this case, the toggle lever 32 is bent in against the force of the preloaded spring 80, as a result of which the first eccentric cam 34 moves out of the area of engagement with the active lever 36. The geometry of the toggle lever 32 is so designed here that a short actuating path covered by the actuating cam 86 is sufficient to move the toggle lever 32 beyond a dead-center position, whereupon the first eccentric member 34, which is under load, effects the further bending-in. As a result of this, even when the toggle lever 32 is under load, only very slight actuating forces are necessary to break the force flow between the first eccentric member 34 and the active lever 36. The rotary catch 26 is freely movable because of the simultaneously released ratchet 24, so that the tailgate can be easily opened or springs up automatically.

Furthermore, the closure device 10 has a pivotably mounted additional lever 86 which holds the ratchet 26 in an open position after release via a catch 88 until it is moved out of the locking position by the opening rotary latch 26 and the intermediate piece 38 pivoting with it, and releases the ratchet 24. The additional lever 86 prevents the ratchet 24 from snapping back into the latching position again directly after release, for example if the tailgate is covered in snow and cannot spring open as a result.

Figure 8:
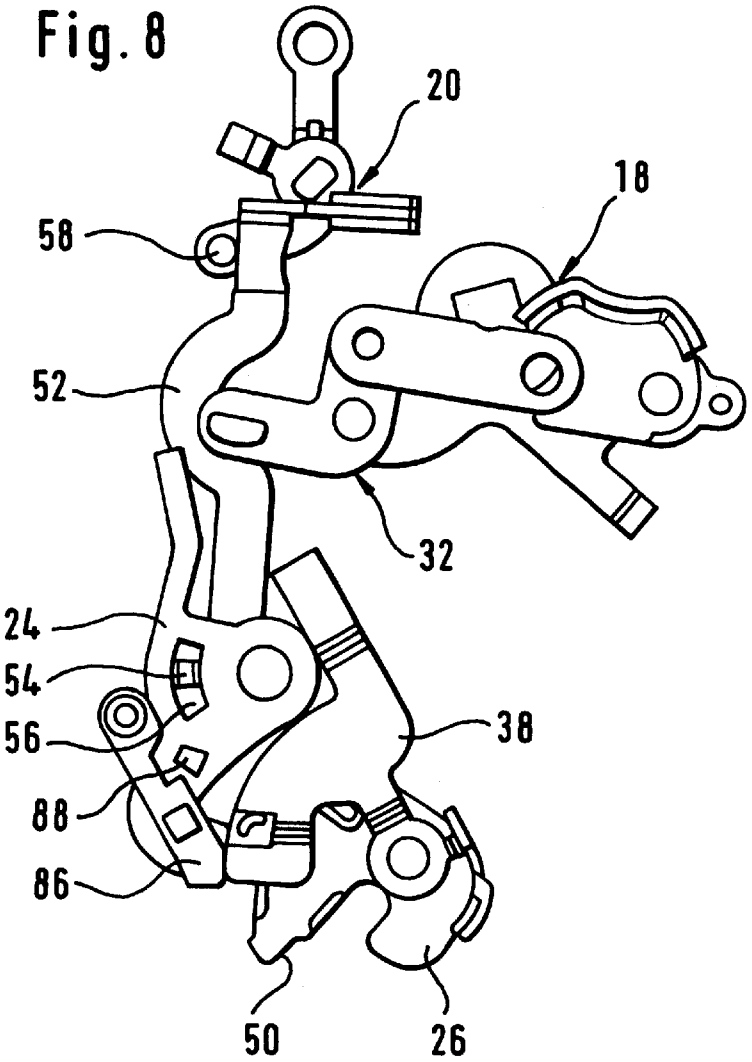
FIG. 8 shows the closure device according to FIG. 2 in the open position.

FIGS. 2 to 8 show various positions of the closure device 10, FIGS. 2 to 5 showing the closure operation, FIG. 6 the emergency release position and FIGS. 7 and 8 the automatic release operation. In FIG. 8, the open position of the closure device 10 is shown, in which the tailgate of the vehicle is open. The shutting aid 18 is located in a central position between the two end positions of the transmission, this position being reachable with the aid of a microswitch (not shown). The rotary latch 26 is shown in its open position, prestressed by a spring (not shown), and the ratchet 24 likewise rests against the flank of the rotary latch 26 under the load of its preloaded spring. If the tailgate is now rested with slight pressure against the bodywork, the closure pin 12 enters into engagement with the rotary latch 26 via the guide aperture 28 (see FIG. 2) and presses the rotary latch 26 into its preliminary latching position (see FIG. 3), in which the latching nose 46 of the ratchet 24 interacts with the preliminary catch 48 on the rotary latch 26. In this position a microswitch (not shown) is simultaneously actuated and activates the shutting aid 18. The start of this rotational movement is already apparent in FIG. 3, the first eccentric member having just entered into engagement with the active lever 36. Via the intermediate piece 38, the eccentric member 34 now entrains the rotary latch 26 into the closed position shown in FIG. 4, until the latching nose 46 of the ratchet 24 snaps into the main catch 50 and thus locks the rotary latch 26. During this, the motor runs up against the end stop defined in the transmission by the toothed wheel segment, this situation being recorded electronically and the electric motor 16 being reversed until it has again moved the shutting aid 18 into its central position (see FIG. 5). The closed position of rest of the closure device 10 is achieved.

Should the user have trapped a finger while pushing the tailgate shut or should an article still be present between the tailgate and the bodywork, the closure device 10 offers the possibility of an emergency release. This emergency release, which is brought about by manual actuation of the hand lever 62, in other words of the tailgate handle, is shown in FIG. 6. The second eccentric member 58 now moves the actuating lever 52, which both releases the ratchet 24 and, via the actuating cam 66, bends in the toggle lever 32, so that the first eccentric member 34 is moved out of the pivot path of the active lever 36. As a result, the rotary latch 26 is completely released and the tailgate springs open under the pressure of the sealing rubber and the preloaded spring of the rotary catch 26. It is also conceivable, in addition to the purely manual emergency release, also to provide an additional motor-driven adjusting member, whereby the emergency release can be triggered, for example, by actuating a push-button. After an emergency release, the preloaded spring 80 of the toggle lever 32 ensures that the latter returns again into its extended position so that the closure device is immediately ready for a further closure operation.

For the motor-driven release of the rotary latch 26 in normal operating states, the electric motor 16 is moved toward its opposite end stop, relative to FIG. 4, as a result of which the entraining lever 64 comes into engagement with the eccentric member 58, and moves the actuating lever 52, and thus the ratchet 24, into its release position (see FIG. 7). It is not necessary for the actuating cam 66 to act on the unloaded toggle lever 32, which merely arises in the example of embodiment shown according to FIG. 7 as a result of the type of geometry selected.

The additional lever 86 locks the ratchet 24 in its open position, the additional lever 86 being unlocked when the tailgate springs open by the intermediate piece 38 springing open together with the rotary latch 26. The closure device 10 thus returns again into its open position shown in FIG. 8, in which it is prepared for a further closing operation.

We claim:

1. A closure device for doors, including doors of motor vehicles, having a rotary latch (26) which interacts with a pin (12) for the locking of a door, a ratchet (24) which arrests the rotary latch (26) at least in the closed position of the door and which can be released with the aid of a release mechanism (52, 58), and a motor-driven shutting aid (18), whereby the door can be pulled over the last part of its closing travel into the closed position, wherein the force flow between a drive (16) of the shutting aid (18) and the door to be closed is interrupted when the release mechanism is actuated, with a first eccentric member (34) of the shutting aid (18) by which an intermediate piece (38) is actuated, said intermediate piece (38) acting on said rotary latch (26), the first eccentric member (34) is arranged on a multi-membered toggle lever (32) which is retained in a basic position by a preloaded spring (80), in which basic position the necessary shutting forces can be transmitted to the rotary latch (26), and which can be moved by mechanical engagement of the release mechanism (52, 58) into a bent-in position in which the first eccentric member (34) is out of its entraining position wherein the release mechanism (52, 58) has a manually or motor actuated actuating lever (52,66) which, in its open position, moves the ratchet (24) out of its engagement with the rotary latch (26) and bends in the toggle lever (32).

2. The closure device as claimed in claim 1, wherein the drive (16) of the shutting aid (18) acts on said first eccentric member (34) which entrains the rotary latch (26) on the last section of its travel into the closed position.

3. The closure device as claimed in claim 2, wherein the first eccentric member (34) acts on said intermediate piece

(38) which is mounted on the pivot (40) of the rotary latch (26), entrains the rotary latch into the closed position and can be pivoted in the opposite direction against the load of a preloaded spring relative to the rotary latch (26).

4. The closure device as claimed in claim 1, wherein an additional lever (86) holds the ratchet (24) in the open position after the release when the door is locked and moves out of engagement with the ratchet (24) as a result of the opening movement of the door and/or of the rotary latch (26).

5. The closure device as claimed in claim 1, wherein the mechanical engagement takes place at an end point on the toggle lever (32) for a minimum force being necessary to bend in the toggle lever (32).

6. The closure device as claimed in claim 1, wherein the release mechanism (52, 58, 66) acts directly on the toggle lever (32, 84).

7. The closure device as claimed in claim 1, wherein the release mechanism (52, 58, 66) has a manually actuated and/or motor-actuated actuating lever (52, 66) which, in its open position, moves the ratchet (24) out of engagement with the rotary latch (26) and bends in the toggle lever (32).

8. The closure device as claimed in claim 7, wherein the actuating lever (52) is mounted about a common pivot (44) with the ratchet (24) and the latter can be pivoted relative to the actuating member (52) by the exertion of pressure by the rotary latch (26) against a preloaded spring.

9. The closure device as claimed in claim 7, wherein a motor-driven second eccentric member (58) entrains the actuating member (52) for release purposes.

10. The closure device as claimed in claim 9, wherein the two eccentric members (34, 58) can be driven by a common motor (16) which is movable between two end positions, the door closing in the region of one end position of the first eccentric member (34) and the second eccentric member (58) releasing the ratchet (24) via the actuating member (52) in the region of the other end position with a reversed direction of rotation of the motor (16).

11. The closure device as claimed in claim 10, wherein the drive (16), when the closure device is opened and closed, can be moved into a defined central position between the two end positions.

12. The closure device as claimed in claim 1, wherein the ratchet (24) arrests the rotary latch (26) in a prelatching position in which the shutting aid (18) can be activated via a microswitch.

13. A closure device for doors, including doors of motor vehicles, having a rotary latch (26) which interacts with a pin (12) for the locking of the door, a ratchet (24) which arrests the rotary latch (26) at least in the closed position of the door and which can be released with the aid of a release mechanism (52, 58), and a motor-driven shutting aid (18), with emergency release means for interrupting the force flow between a drive of the shutting aid and the door to be closed when the release mechanism is actuated, whereby the door can be pulled over the last part of its closing travel into the closed position, wherein, when the release mechanism (52, 58, 66) is actuated, the force flow between the drive (16) of the shutting aid (18) and the door to be closed is simultaneously mechanically interrupted, wherein a first eccentric member (34) of the shutting aid (18) by which an intermediate piece (38) is actuated, said intermediate piece (38) acting on said rotary latch (26), the first eccentric member (34) is arranged on a multi-membered toggle lever (32) which is retained in a basic position by a preloaded spring (80), wherein the release mechanism (52, 58) has a manually or motor actuated actuating lever (52,66) which, in its open position, moves the ratchet (24) out of its engagement with the rotary latch (26) and bends in the toggle lever (32).

* * * * *